United States Patent [19]

Israel et al.

[11] Patent Number: 4,685,599

[45] Date of Patent: Aug. 11, 1987

[54] NOVELTY WRISTWATCH

[75] Inventors: Cheryl Israel; Melissa M. Morgan, both of Providence, R.I.

[73] Assignee: Hasbro, Inc., Pawtucket, R.I.

[21] Appl. No.: 907,597

[22] Filed: Sep. 15, 1986

[51] Int. Cl.[4] ..... A44C 5/00

[52] U.S. Cl. ..... 224/170; D10/32; 224/164; 224/219; 368/45

[58] Field of Search ..... D10/32, 33; D11/31, D11/100; 24/265; 63/3–7; 368/282, 45; 224/164–178, 219, 222, 901, 267; 446/371, 394, 268

[56] References Cited

U.S. PATENT DOCUMENTS

| | | | |
|---|---|---|---|
| D. 99,941 | 6/1936 | Hammond | D10/33 |
| D. 111,613 | 10/1938 | Pohli | D10/33 |
| D. 155,252 | 9/1949 | Wolf . | |
| D. 166,416 | 4/1952 | Roumm et al. | D11/100 |
| D. 202,626 | 10/1965 | Mitchell . | |
| D. 205,039 | 6/1966 | Anello . | |
| D. 261,249 | 10/1981 | Birmingham . | |
| D. 284,948 | 8/1986 | Ogawa | D10/32 X |
| D. 287,698 | 1/1987 | Ogawa | D10/32 X |
| 804,493 | 11/1905 | McCarthy | 224/222 |
| 1,309,150 | 7/1919 | Monfort | 224/164 X |
| 1,309,988 | 7/1919 | Knyvett . | |
| 1,714,732 | 5/1929 | Schneider | 224/219 X |
| 3,365,877 | 1/1968 | Altman | 224/170 X |
| 3,543,977 | 12/1970 | Lockridge | 224/222 |
| 3,628,351 | 12/1971 | Chernow | D11/31 X |
| 3,700,148 | 10/1972 | Lanvin . | |
| 4,155,219 | 5/1979 | Anderson . | |
| 4,387,838 | 6/1983 | Jackson . | |
| 4,482,256 | 11/1984 | Matsuda | 388/45 X |

FOREIGN PATENT DOCUMENTS

| | | | |
|---|---|---|---|
| 1029571 | 4/1978 | Canada | 224/170 |

*Primary Examiner*—Stephen Marcus
*Assistant Examiner*—Robert M. Petrik
*Attorney, Agent, or Firm*—Salter & Michaelson

[57] ABSTRACT

A child's wristwatch construction comprises a strap element which is detachably securable on a wrist of a wearer, an enlarged three-dimensional ornament element which is attached to the strap element, and a timepiece element which is attached to either the ornament element or the strap element. The ornament element is preferably made in a plush toy construction and embodied as the head of a three-dimensional character, and it is secured to the strap element so that it is hingeable between an open position wherein it is hinged outwardly and away from the strap element and a closed position wherein the timepiece element is concealed.

7 Claims, 8 Drawing Figures

NOVELTY WRISTWATCH

BACKGROUND AND SUMMARY OF THE INVENTION

The instant invention relates to wristwatches and more particularly to novelty wristwatches for children.

Although a variety of different wristwatches have been heretofore available which have been specifically adapted for use by children, most of them have been of basically conventional construction. More specifically, most of the heretofore available wristwatches which have been specifically adapted for use by children have included conventional straps and conventional wristwatch-type timepiece elements, although many of them have been designed to include various ornamention in order to increase their appeal to young children. For example, wristwatches have been heretofore available which have included character faces on the dials or faces of the timepiece elements thereof, and hands which resemble the hands of the characters embodied in the character faces thereon.

Other types of heretofore available wristwatch constructions which have not necessarily been specifically adapted for use by children but which represent the closest prior art to the subject invention of which the applicant is aware are disclosed in the Knyvett U.S. Pat. No. 1,309,988; Lanvin U.S. Pat. No. 3,700,148; Anderson U.S. Pat. No. 4,155,219; and Jackson U.S. Pat. No. 4,387,838. However, since these references fail to disclose a wristwatch construction having the novel structural features of the wristwatch construction of the instant invention which make it particularly adapted for use by and appealing to children, they are believed to be of only general interest with respect to the subject invention.

The instant invention provides a novel and appealing wristwatch construction which can be effectively utilized by a child for determining the time of day and which also provides a significant amount of amusement and play value for the child. Specifically, the wristwatch construction of the instant invention includes an enlarged three-dimensional ornament element which is preferably embodied as the head of a plush toy character and which is displayed on the wrist of a child when the wristwatch is secured on the child's wrist. More specifically, the wristwatch construction of the instant invention comprises a strap element which is detachably securable on a wrist of a wearer, an enlarged three-dimensional ornament element which is hingeably attached to the strap element, and a timepiece element which is secured to either the strap element or to the ornament element. The ornament element is secured to the strap element so that is it hingeable between a closed position wherein it overlies a portion of the strap element and an open position wherein it is hinged outwardly relative to the strap element. The timepiece element can be secured to either the strap element or to the ornament element, and it is positioned so that when the ornament element is in the closed position thereof the timepiece element is interposed and concealed between the strap element and the ornament element, and so that when the ornament element is in the open position thereof, the timepiece element is exposed and visible to the wearer. The ornament element and the strap element are preferably both embodied in plush toy type constructions, and the ornament element is preferably formed so that it defines the head of an amusing character, and it is preferably positioned so that when the ornament element is in the closed position and the wrist on which the wristwatch is mounted is positioned in front of the wearer, the facial portion of the character head faces toward the wearer. The ornament element is further preferably secured on the strap element so that when the wristwatch is positioned in front of the wearer it is hingeable outwardly and away from the wearer to expose the timepiece element to the wearer. The strap element preferably further includes an enlarged base portion which defines the lower jaw portion of the character, and the ornament element preferably defines the upper jaw and head portion of the character. The ornament element and the base portion are preferably constructed so that they cooperate to define a mouth of the character head which moves to an open position when the ornament element is moved to the open position. Further, in one embodiment of the wristwatch construction the base portion of the strap element has an aperture therethrough, and the free end portion of the strap element is receivable and securable in a position wherein it extends through the aperture in the base portion and outwardly between the base portion and the ornament element. When the strap element is secured in this position, the main portion of the strap element is operable for securing the wristwatch on a wrist of a wearer; whereas the outwardly extending free end portion of the strap element defines an outwardly extending free end portion of the strap element defines an outwardly extending tongue of the character head embodied in the ornament element.

Accordingly, it is seen that the instant invention provides an effective and amusing wristwatch construction which is particularly adapted for use by children. The wristwatch includes an ornament element which is preferably embodied as a plush toy type character head and which provides a high degree of amusement and play value. However, the ornament element is hingeable to an open position relative to the strap element to expose the timepiece element so that a child can determine the time of day. Hence, the wristwatch construction of the instant invention has a high degree of play value for a child, and it also has a practical value as a timepiece for the child.

Accordingly, it is a primary object of the instant invention to provide a wristwatch construction for a child which has a high degree of play value.

Another object of the instant invention is to provide a wristwatch construction which includes a plush toy type character head.

A still further object of the instant invention is to provide a combination plush toy and wristwatch.

Other objects, features and advantages of the invention shall become apparent as the description thereof proceeds when considered in connection with the accompanying illustrative drawings.

DESCRIPTION OF THE DRAWINGS

In the drawings which illustrate the base mode presently contemplated for carrying out the present invention.

DESCRIPTION OF THE INVENTION

Figure 1:
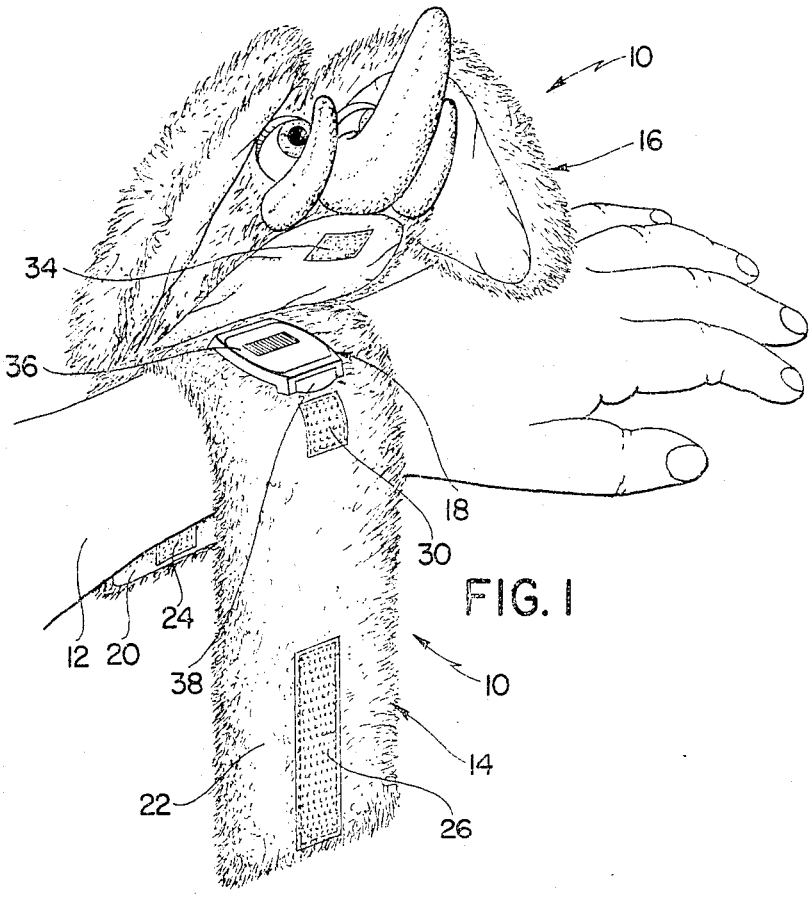
FIG. 1 is a perspective view of a first embodiment of the wristwatch construction of the instant invention positioned adjacent a wrist of a wearer with the ornament element in the open position.

Referring now to the drawing, a first embodiment of the wristwatch construction of the instant invention is illustrated in FIGS. 1 through 5 and generally indicated at 10. The wristwatch 10 is adapted to be mounted on a wrist 12 of a wearer, and it comprises a strap element generally indicated at 14, an ornament element generally indicated at 16, and a timepiece element generally indicated at 18. The strap element 14 is adapted to be releasably secured on the wrist 12, and the timepiece element 18 is secured on the outer side of the strap element 14. The ornament element 16 is hingeably secured to the strap element 14 so that it is alternatively positionable in the closed position illustrated in FIG. 2 wherein it overlies the timepiece element 18 or the open position thereof illustrated in FIG. 3 wherein it is hinged outwardly with respect to the strap element 14 so that the timepiece element 18 is exposed and visible to the wearer.

Figure 2:
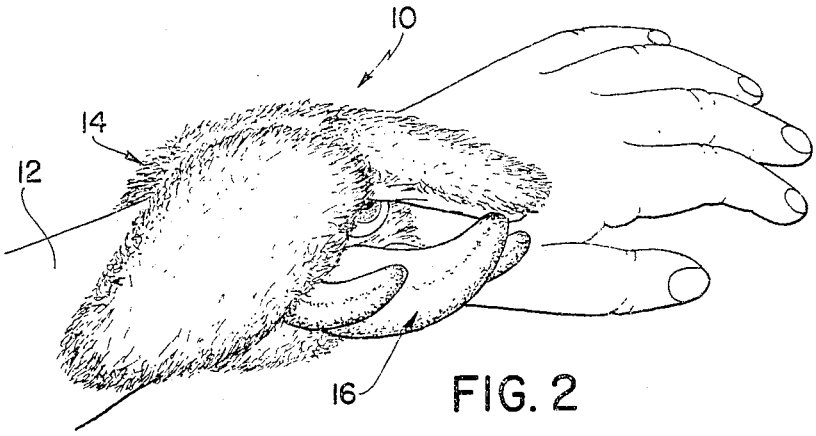
FIG. 2 is a perspective view of the wristwatch on the wrist of a wearer with the ornament element in the closed position.
Figure 3:
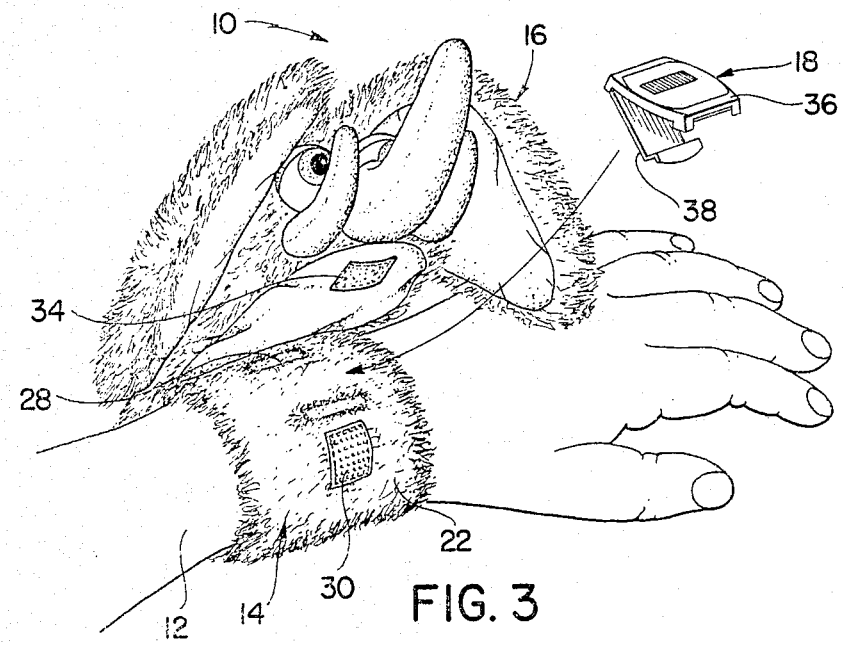
FIG. 3 is a similar view with the ornament element in the open position.
Figure 4:
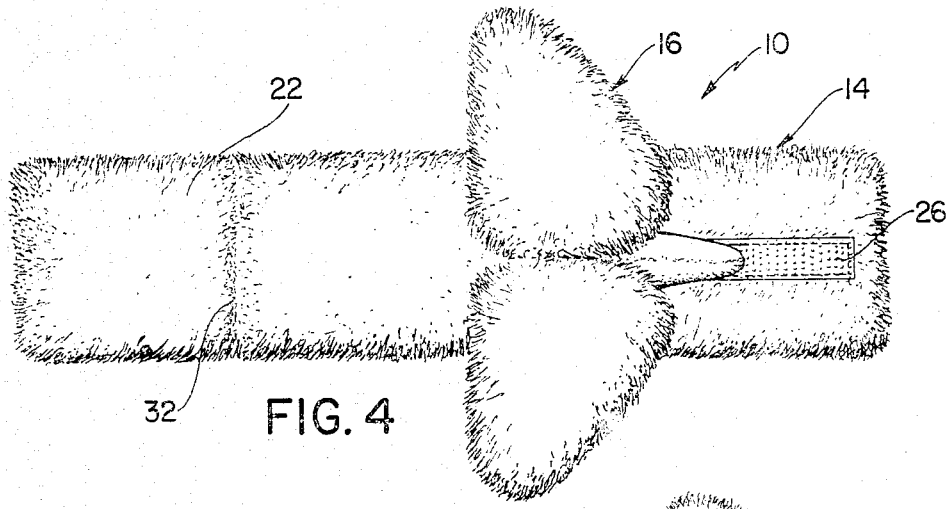
FIG. 4 is a top plan view of the wristwatch with the ornament element in the close position.
Figure 5:
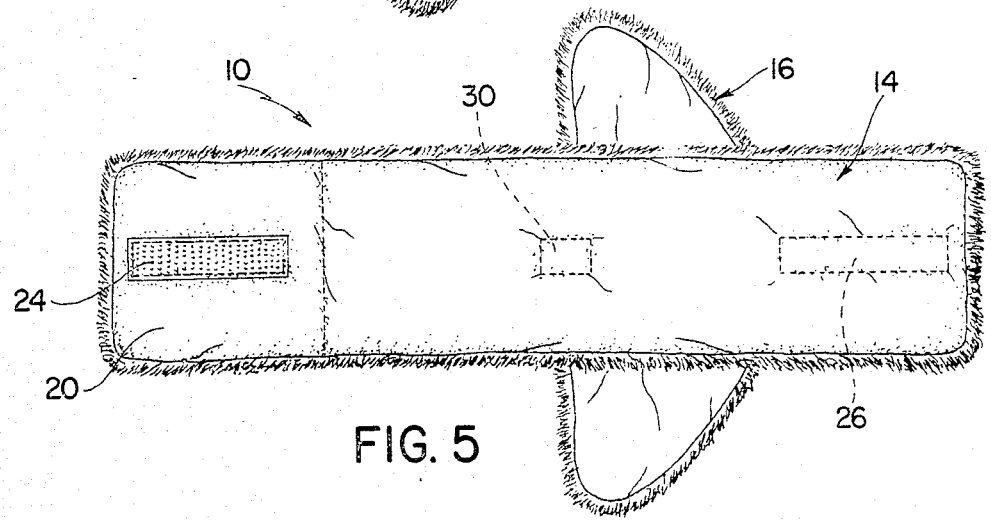
FIG. 5 is a bottom plane view thereof.

The strap element 14 is preferably embodied in a soft plush toy type construction, and the inner side of the strap element 14 is preferably defined by a soft first fabric layer 20, whereas the outer side of the strap element 14 is preferably defined by a soft plush second fabric layer 22. A first fastening element 24 which preferably comprises a VELCRO (Velcro USA Inc. TM) hook and loop type fastening element is provided on the first fabric layer 20 adjacent one end of the strap element 14, and a second fastening element of complementary configuration is provided on the outer fabric layer 22 adjacent the opposite end of the strap element 14. The strap element 14 is dimensioned to be received on the wrist 12 so that the first fastening element 24 overlies the second fastening element 26 to secure the wristwatch 20 on the wrist 12 as illustrated in FIGS. 1 through 3. Provided in the outer layer 22 of the strap element 14 are two spaced, substantially parallel transverse slots 28 which are dimensioned and adapted for receiving and securing the timepiece element 18 on the strap element 14 in a manner which will hereinafter be more fully set forth. Also provided on the outer layer 22 is a fastening element 30 which preferably comprises a VLECRO (Velcro USA Inc. TM) hook and loop type fastening element and which is interengageable with a fastening element of complementary configuration on the ornament element 16.

The ornament element 16 is preferably embodied as a character head and made in a plush toy construction, and it is hingeably secured to the strap element 14 along a transverse hinge line 32 so that it is hingeable between a closed postion wherein it overlies the timepiece element 18 and the adjacent portion of the strap element 14 and an open position wherein it is hinged outwardly and away from the strap element 14 to expose the timepiece element 18. The ornament element 16 preferably includes a fastening element 34 on the underside thereof which is of complementary configuration to the fastening element 30 on the strap element 14, and the fastening element 34 is positioned so that it is interengageable with the fastening element 30 for securing the ornament element 16 in the closed position. As will be seen most clearly from FIGS. 1 and 3, the ornament element 16 is preferably embodied as an enlarged three-dimensional plush toy type character head, and it is positioned on the strap element 14 so that when the ornament element 16 is in the closed position and the wristwatch 10 is secured on the wrist 12, the ornament element 16 is displayed on the wrist 12 so that it faces the wearer when the wrist 12 is positioned in front of the wearer. Further, the ornament element 16 is preferably formed so that it cooperates with the strap element 14 for defining a mouth of the character embodied in the ornament element 16, and so that when the ornament element 16 is hinged upwardly and away from the strap element 14 to the open position, the mouth of the character is moved to an open position.

The timepiece element 18 preferably comprises a conventional digital or analog timepiece element, and it includes a main timepiece portion 36 and a rear attachment plate 38 which is hingeably attached to the main portion 36 at one end thereof and engageable with the opposite end of the main portion 36 to define a loop on the rear side of the timepiece element 18. The plate 38 is receivable through the slots 28 so that it passes between the front and rear layers 22 and 20 of the strap element 14 for securing the timepiece element 18 thereto.

For use of the wristwatch 10, the strap element 14 is positioned on the wrist 12 in the manner illustrated in FIG. 1, and the fastening element 24 is positioned so that it overlies the fastening element 26 and is interengaged therewith for securing the strap element 14 on the wrist 12. When the wristwatch 10 is secured on the wrist 12 in this manner, and the ornament element 16 is in the closed position, the ornament element 16 is displayed on the wrist 12 so that it faces toward the wearer. However, in order to determine the correct time of day with the wristwatch 10, the fastening element 34 is disengaged from the fastening element 30, and the ornament element 16 is hinged outwardly and away from the strap element 14 to expose the timepiece element 18. Thereafter, the ornament element 16 can again be moved to the closed position by hinging it inwardly over the timepiece element 18 so that the fastening elements 34 and 36 are interengagable to secure the ornament element 16 in the closed position wherein it overlies the timepiece element 18 and the character embodied in the ornament element 16 is displayed more closely adjacent the wrist 12. Accordingly, it is seen that the instant invention effectively combines a plush toy in a wristwatch construction to provide a substantial amount of amusement value therein, while nevertheless providing the practical benefits of a timepiece.

Figure 6:
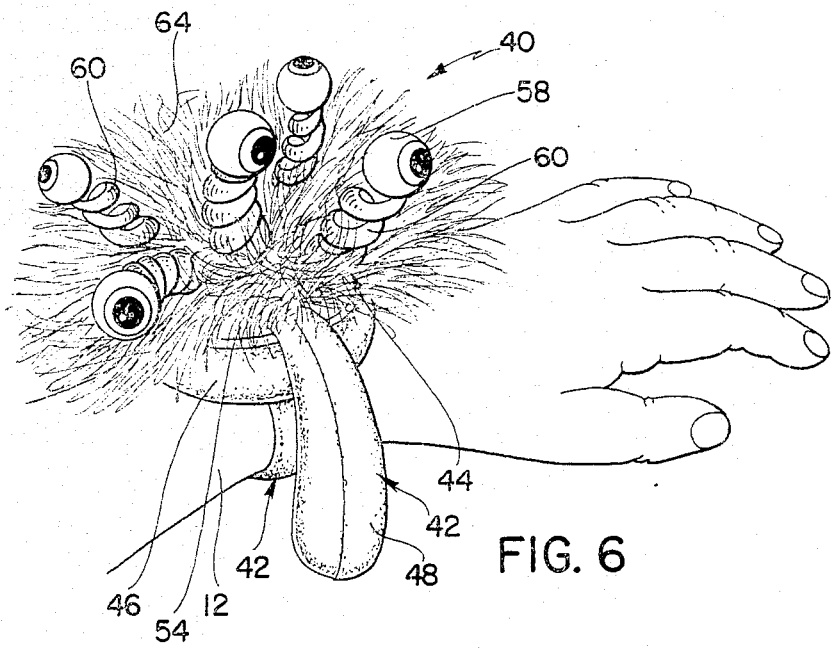
FIG. 6 is a perspective view of a second embodiment of the wristwatch on a wrist of a wearer with the ornament element in the closed position.
Figure 7:
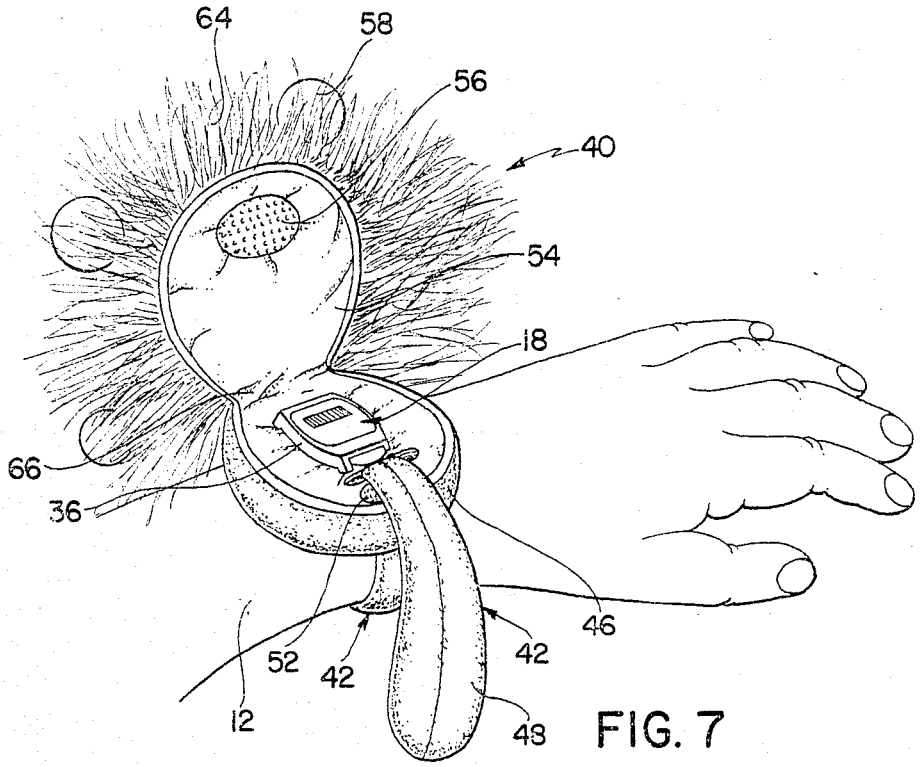
FIG. 7 is a similar view with the ornament element in the open position.
Figure 8:
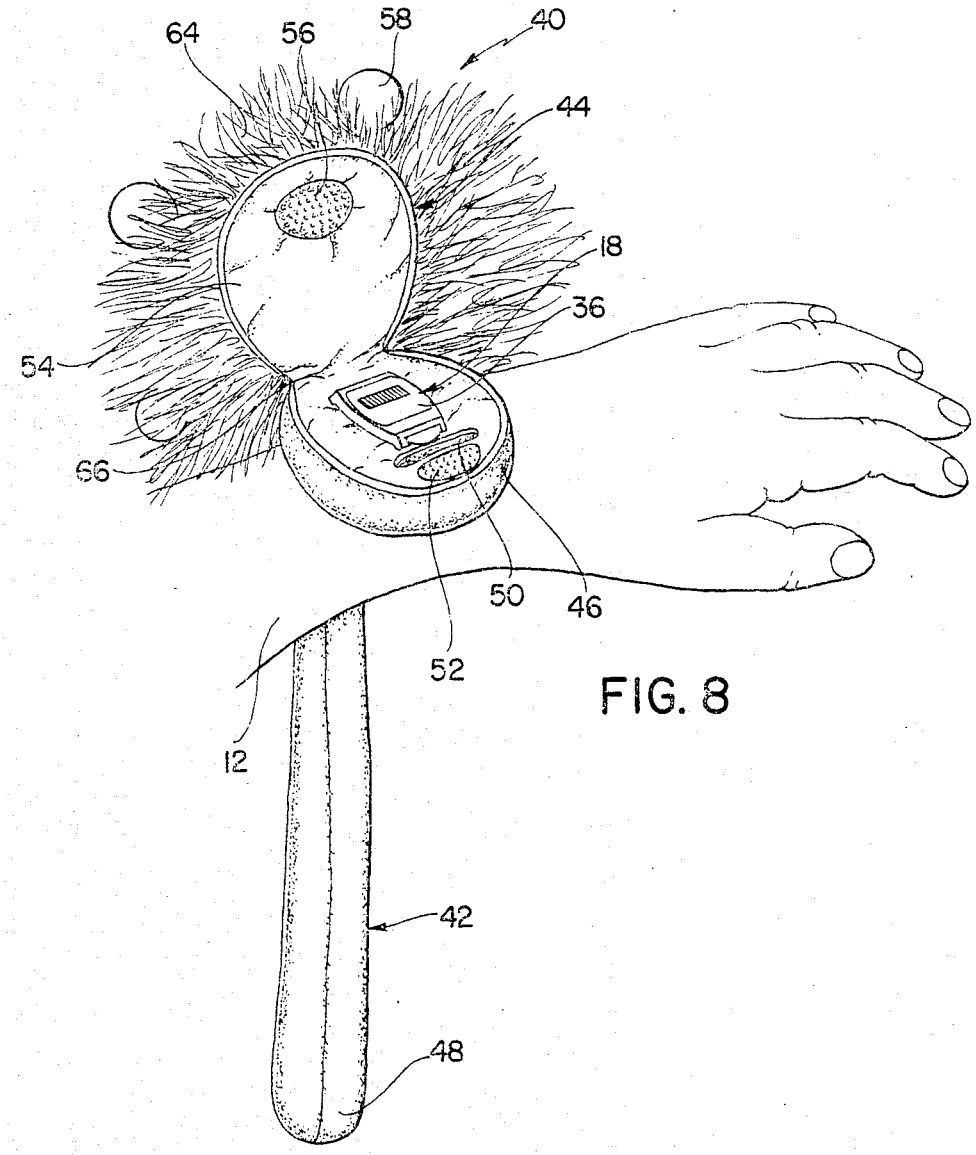
FIG. 8 is a perspective view of the second embodiment of the wristwatch positioned adjacent a wrist of a wearer prior to securing it on the wrist.

A second embodiment of the wristwatch of the instant invention is illustrated in FIGS. 6 through 8 and generally indicated at 40. The wristwatch 40 comprises a strap element generally indicated at 42, a ornament element generally indicated at 44, and a timepiece element 18, and it is securable on a wrist 12 in the manner illustrated. The strap element 42 includes an enlarged base portion 46 at one end thereof, and the remainder of the strap element 14 is preferably constructed in a reduced width with respect to the base portion 46 and formed in the configuration of an elongated tongue which terminates in a free end portion 48. The strap element 42 is preferably made of a suitable soft fabric material in a plush toy construction, and the base portion 46 is preferably formed as a soft circular stuffed pad which is receivable on the upper side of the wrist 12. The base portion 46 has a transverse slot 50 therethrough which is dimensioned to receive the free end portion 48 of the strap element 42 for securing the wristwatch 40 on the wrist 12. Provided on the upper surface of the base portion 46 adjacent the slot 50 is a fastening element 52, and two slots (not shown) which are similar to the slots 28 in the strap element 14 are provided on the upper surface of the base portion 46 for securing the timepiece element 18 thereto.

The ornament element 44 is also preferably embodied in a plush toy construction, and it defines the upper portion of the head of an amusing character. In this connection, the ornament element 44 includes a body portion 54 which is preferably of plush toy construction and has a fastening element 56 thereon. A plurality of eye elements 58 which are mounted on resilient coils 60 extend upwardly through elongated hair 64 on the upper side of the body portion 54 to provide an amusing appearance for the character embodied in the ornament element 44. The ornament element 44 is secured to the base portion 46 of the strap element 42 along a hinge line 66, and it is dimensioned so that it is receivable in overlying relation on the base portion 46 for covering and concealing the timepiece element 18. The fastening element 56 is positioned on the underside of the body portion 54 of the ornament element 44 so that it is aligned with the fastening element 52 on the base portion 46 when the ornament element 44 is in the closed position, and the fastening elements 52 and 56 are preferably embodied as VELCRO (Velcro USA Inc. TM) hook and loop type fastening elements. In this connection, the strap element 42 is positionable so that it extends between the fastening elements 52 and 56; and since the strap element 42 is preferably made of a soft fabric material, it is also interengageable with the fastening elements 52 and 56 so that the fastening elements 52 and 56 not only cooperate to retain the ornament element 44 in the closed position but so that they also cooperate to secure the strap element 42 on the wrist 12. When the strap element 42 is secured between the base portion 46 and the body portion 54 in this manner, it preferably extends outwardly from the ornament element 44 to define a tongue of the character embodied in the ornament element 44 as illustrated in FIG. 6. Further, the base portion 46 is preferably constructed so that it defines the lower jaw of the character, and the ornament element 44 is preferably constructed so that it embodies the upper jaw and head portion of the character. Accordingly, when the ornament element 44 is in the closed position thereof, the terminal end portion 48 defines a tongue which extends outwardly from the closed mouth of the character; whereas when the ornament element 44 is in the open position thereof, the mouth of the character is also in an open position, and the tongue nevertheless extends outwardly from the open mounth.

Accordingly, for use and operation of the wristwatch 40, the strap element 42 is positioned on the wrist 12 of a wearer as illustrated in FIG. 8, the terminal end portion 48 of the strap element 42 is inserted upwardly through the slot 50, and the strap element 42 is interengaged with the fastening element 52. The ornament element 44 can then be moved between the open position thereof illustrated in FIG. 7 for viewing the timepiece element 18 and the closed position thereof illustrated in FIG. 6. Accordingly, the wristwatch 40 also has both amusement or play value and practical value, and it is therefore highly desirable for use by a child.

It is seen, therefore, that the instant invention provides an effective wristwatch construction which has a high degree of play value as well as a significant practical value. The wristwatches 20 and 40 include ornament elements which define interesting and amusing character heads, and they are securable on the wrists of children so that the character heads thereof are displayed thereon. The ornament elements 16 and 44 are, however, movable to open positions thereof for displaying the timepiece elements 18 of the wristwatches 10 and 40, respectively. Accordingly, it is seen that the instant invention provides a practical and amusing wristwatch construction which represents a significant advancement in the toy art.

While there is shown and described herein certain specific structure embodying the invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. A novelty wristwatch comprising:

(a) a strap element detachably securable on a wrist of a wearer;

(b) an enlarged three-dimensional plush toy element on said strap element, said plush toy element being of the plush-toy-type construction and defining the head portion of an imaginary character figure, said head portion having a mouth and being hingeable between a closed position wherein said mouth is closed and an open position wherein said mouth is open and being releasably securable in said closed position; and (c) a timepiece element mounted in the mouth of said head portion so that it is concealed therein when said head portion is in said closed position but visible to said wearer when said head portion is in said open position.

2. In the wristwatch of claim 1, said character head further characterized as including a face portion.

3. A novelty wristwatch comprising a character element of plush-toy-type construction defining the head portion of an imaginary character figure, said head portion having a mouth and being hingeable between a closed position wherein said mouth is closed and an open position wherein said mouth is open and being releasable securable in said closed position, strap means for detachably securing said character element on a wrist of a wearer; and a timepiece element mounted in the mouth of said head portion so that it is concealed therein when said head portion is in said closed position but visible to said wearer when said head portion is in said open position, whereby when said plush toy is secured on said wrist, said character element provides a plush toy character which moves with said wrist and which is movable to an open position to enable said wearer to determine the time of day.

4. A novelty wristwatch comprising a strap element detachably securable on a wrist of a wearer and including an elongated base portion at one end thereof, said base portion having an aperture therethrough and defining the lower jaw of a character figure, an enlarged three-dimensional ornament element defining the upper jaw and upper head portion of said character figure, said upper and lower jaws cooperating to define a mouth of said character figure, said ornament element being hingeably attached to said strap element so that it is hingeable between a closed position wherein it overlies said base portion and the mouth of said character figure is closed and an open position wherein said ornament element is hinged outwardly relative to said base portion and the mouth of said character figure is open, the end portion of said strap element opposite from said base portion being receivable and securable in a position wherein it extends through said aperture and outwardly between said base portion and said ornament element to secure said wristwatch on said wrist and to define an outwardly extending tongue of said character figure, and a timepiece element mounted in said mouth of said character figure so that it is concealed between said ornament element and base base portion when said ornament element is in said closed position but visible to said wearer when said ornament element is in said open position.

5. In the wristwatch construction of claim 4, said strap element further characterized as being of plush toy type construction.

6. A novelty wristwatch comprising:

(a) a strap element detachable securable on a wrist of a wearer;

(b) an enlarged three-dimensional toy element on said strap element, said toy element defining the head portion of an imaginary character figure, said head portion having a mouth and being hingeable between a closed position wherein said mouth is closed and an open position wherein said mouth is open and being releasably securable in said closed position; and (c) a timepiece element mounted in the mouth of said head portion so that it is concealed therein when said head portion is in said closed position but visible to said wearer when said head portion is in said open position.

7. A novelty wristwatch comprising:

(a) a strap element detachable securable on a wrist of a wearer;

(b) an enlarged three-dimensional toy element on said strap element, said toy element including a head portion of an imaginary character figure, said toy element being hingeable between a closed position wherein it overlies said strap element and an open position wherein it is hinged outwardly with respect to said strap element and being releasably securable in said closed position; and (c) a timepiece element mounted on one of said toy element or said strap element so that it is concealed therebetween when said toy element is in said closed position but visible to said wearer when said toy element in in said open position.

* * * * *